US009524626B2

(12) United States Patent
Brühwiler et al.

(10) Patent No.: US 9,524,626 B2
(45) Date of Patent: Dec. 20, 2016

(54) SECURING DEVICE FOR OBJECTS

(75) Inventors: Cornel Brühwiler, Gossau (CH); Jürgen Kreider, Todtmoos (DE)

(73) Assignee: Pataco AG, Henau (CH)

( * ) Notice: Subject to any disclaimer, the term of this patent is extended or adjusted under 35 U.S.C. 154(b) by 275 days.

(21) Appl. No.: 13/702,891

(22) PCT Filed: Jun. 7, 2011

(86) PCT No.: PCT/CH2011/000134

§ 371 (c)(1),
(2), (4) Date: Feb. 21, 2013

(87) PCT Pub. No.: WO2011/153651

PCT Pub. Date: Dec. 15, 2011

(65) Prior Publication Data

US 2013/0169440 A1 Jul. 4, 2013

(30) Foreign Application Priority Data

Jun. 7, 2010 (CH) ..... 0902/10

(51) Int. Cl.

| | |
|---|---|
| ***G08B 13/14*** | (2006.01) |
| ***G08B 13/00*** | (2006.01) |
| ***G08B 13/24*** | (2006.01) |
| *E05B 73/00* | (2006.01) |

(52) U.S. Cl.

CPC ..... *G08B 13/00* (2013.01); *E05B 73/0029* (2013.01); *G08B 13/2434* (2013.01); *E05B 73/0017* (2013.01)

(58) Field of Classification Search

CPC .. E05B 73/00; E05B 73/0017; E05B 73/0029; G08B 13/00; G08B 13/2434

USPC ..... 340/572.9

See application file for complete search history.

(56) References Cited

U.S. PATENT DOCUMENTS

| | | | | |
|---|---|---|---|---|
| 5,349,834 | A | 9/1994 | Davidge | |
| 5,491,956 | A * | 2/1996 | Donnelly | B65B 11/045 53/399 |
| 5,627,520 | A * | 5/1997 | Grubbs | G07C 9/00111 340/539.1 |
| 5,699,591 | A | 12/1997 | Kane | |
| 5,709,110 | A | 1/1998 | Greenfield et al. | |

(Continued)

FOREIGN PATENT DOCUMENTS

WO WO 2008/009148 1/2008

*Primary Examiner* — Hai Phan
*Assistant Examiner* — Zhen Y Wu
(74) *Attorney, Agent, or Firm* — Walter Haverfield LLP; D. Peter Hochberg; Sean F. Mellino

(57) ABSTRACT

A securing device for attachment of an object (2) which is to be secured. The securing device has a housing with a base plate and a lid as well as an apparatus for generating an alarm when the securing device is removed from the object without authorization. The securing device has an open and closed state. In the closed state the base plate and the lid can be locked to one another by a lock. The apparatus for generating an alarm comprises a mechanical sensor and/or an optical sensor In the closed state the mechanical sensor can detect contact with the object by the base plate and can react to a loss of contact with the object. In the closed state the optical sensor emits light through the base plate, and can sense reflections of this light from the object through the base plate and can react to changes in these reflections.

20 Claims, 6 Drawing Sheets

(56) References Cited

U.S. PATENT DOCUMENTS 5,886,633 A 3/1999 Adams
5,910,768 A 6/1999 Ott
6,105,922 A 8/2000 Derman
6,243,005 B1 * 6/2001 Haimovich ..... G09F 3/0329 340/427
6,578,394 B2 * 6/2003 Yin ..... E05B 73/0005 248/551
8,514,070 B2 * 8/2013 Roper ..... G08B 21/0286 340/539.13
9,103,142 B2 8/2015 Abdollahzadeh et al.
2005/0046553 A1 * 3/2005 Flick ..... B60R 25/104 340/426.1
2006/0044800 A1 * 3/2006 Reime ..... B60Q 3/001 362/276
2007/0080806 A1 4/2007 Lax et al.
2007/0171061 A1 7/2007 Belden et al.
2008/0018066 A1 * 1/2008 Pickford ..... A43B 1/0081 280/11.3
2008/0236209 A1 * 10/2008 Conti ..... E05B 45/005 70/18
2008/0246656 A1 * 10/2008 Ghazarian ..... G08B 25/016 342/357.54
2009/0158786 A1 * 6/2009 Fawcett ..... E05B 45/005 70/57
2009/0287498 A2 * 11/2009 Mr. Choi ..... G06Q 30/012 705/1.1
2009/0289798 A1 * 11/2009 Yang ..... G08B 13/1463 340/572.8
2010/0147041 A1 * 6/2010 Teicher ..... E05B 73/0005 70/58
2010/0171621 A1 * 7/2010 Yang ..... G08B 13/1463 340/572.9
2010/0188222 A1 * 7/2010 Irmscher ..... A47F 7/024 340/568.2
2010/0207769 A1 * 8/2010 Pokrajac ..... G08B 21/0286 340/600
2013/0169440 A1 * 7/2013 Bruhwiler ..... E05B 73/0029 340/572.9

* cited by examiner

SECURING DEVICE FOR OBJECTS

CROSS-REFERENCE TO RELATED APPLICATIONS

This application is a National Stage application of International Application No. PCT/CH2011/000134, filed on Jun. 7, 2011, which claims priority of Swiss application Ser. No. 00902/10, filed on Jun. 7, 2010, both of which are incorporated herein by reference in their entireties.

BACKGROUND OF THE INVENTION

Field of the Invention

The invention relates to a securing device for attachment to an object that is to be secured. The securing device has a housing with a base plate and a lid as well as apparatus for generating an alarm when the securing device is removed from the object without authorization. The securing device has an open and a closed state, and in the closed state the base plate and the lid can be locked to one another by a lock.

Description of the Prior Art

For securing goods in retail stores against theft, electronic goods securing systems have proven useful. In this method, tags, which are detectable by the system electronics, are attached to the goods to be secured, by antennas generally positioned at the exit of the retail store. The tags, for example, may comprise electrical resonance oscillating circuits with resonance frequencies in the radio frequency range (several MHz).

In order for the securing to function, the tags must be connected to the goods to be secured in such a manner that they cannot be removed easily and unobtrusively by unauthorized persons. For example, in the case of items of clothing this is accomplished in that a pin is stuck through the fabric and the tip of the pin is secured with a lock that requires special equipment to remove it. The tag is placed in the pin head (hard tag) or in the lock. Small articles can be placed in transparent, lockable containers, which contain the tag in their interior. For securing goods that are sold in cartons or the like, tags in housings are used, which are fastened to the packaging with belts (or cables).

In one embodiment, the belts are electrically conductive and are monitored for electrical continuity by an electronic system. If they are cut for unauthorized removal of the securing device, the electronics system produces an alarm. A mechanical system is placed in the housing for winding around and clamping the belts. Since this may not be as voluminous as might be desired, the displacement range of the belts is limited, which restricts their use to packaging in a certain size range.

In WO2008/0009148, a securing device is suggested for objects which are strapped with simple, electrically nonconductive belts, such as are standard for use in packaging technology. The belts are made of stable plastic and are clamped around the packages with a clamping device, wherein their ends are connected together into a closed loop using closure sleeves or by welding. There are no limitations with regard to the size of the packages. The securing device has two housing shells, which can be locked together and meshed with the belts. The device also contains two cylindrical, rotatably supported clamping elements, each provided with a slit for the belts and pretensioned with clamping springs. When the securing device is applied to the object, the belts are passed through the slit of the clamping elements. Through the closing and locking of the two housing shells, blocking of the clamping element is released and the belts are additionally tensioned. These apparatus for additionally tensioning the belts are connected to an alarm. If the additional tensioning is lost, e.g., by unauthorized cutting of the belts, the clamping elements turn further because of the clamping springs, thus setting off an alarm.

In the case of a suitable geometric arrangement, the belts can also prevent the package from being opened. Frequently the contents of the package are not checked during the sale. Not infrequently, then, when the item is unpacked at home, it is found that the contents do not meet expectations. This may happen because the package has been opened during transport, in storage, or in the retail store, and the goods contained therein removed, and in the best case replaced by a different and usually less valuable item. In addition, high-end, expensive goods are not infrequently placed in the packages of less expensive goods so the buyer only has to pay the lower price of the less expensive item at the cash register.

SUMMARY OF THE PRESENT INVENTION

The invention has the objective of suggesting a securing device of the initially-mentioned type which can be applied to objects such as large packaging cartons in such a way that they cannot be removed from these without being noticed, which requires no expensive mechanical arrangements, and nevertheless guarantees adequate protection.

This is achieved according to the presently claimed invention in such a securing device. Here the apparatus for producing an alarm comprises a mechanical and/or an optical sensor. The mechanical sensor in the closed state can detect contact with the object and can react to loss of contact with the object. In particular, it emits an alarm if the securing device is removed from the object without authorization. In the closed state, the optical sensor emits light through the base plate, can detect reflections of this light from the object through the base plate, and can respond to changes in these reflections. The optical sensor likewise triggers an alarm if the securing device is removed from the object without authorization.

Depending on the method of applying the securing device to the object (e.g., by belts as is currently done) it might be possible to move the securing device somewhat on the object or to slip a flat article between the securing device and the object: the latter for example to prevent reaction of the mechanical sensor. However, if this were done, the optical sensor would respond.

For easier handling, the base plate and lid can be connected to one another movably over the hinge.

The mechanical sensor can comprise a contact or end position sensor.

The optical sensor can comprise a reflected electric eye or an image sensor, which is preferably insensitive to ambient light. The light that it emits is furthermore preferably infrared light. However, it may also be provided that the optical sensor responds to ambient light when the securing device is lifted from the object.

The apparatus for generating an alarm preferably has a resonant oscillating circuit detectable by an electronic securing device for objects. The object to be secured then cannot be easily removed from an area, such as a retail store, monitored by an electronic object securing system before removing it from the object. As soon as the electronic object securing unit detects the resonant oscillating circuit in the securing device according to the invention, it will emit an alarm.

On the other hand, the apparatus for generating an alarm of the securing device according to the invention can generate an alarm if the resonant oscillating circuit is energized by an electronic goods securing system through the electromagnetic alternating current field generated thereby.

The lock is preferably activated during and by the closure of the securing device. It should be able to be undone only with a special tool, e.g., magnetically with a magnetic opener, such as is used for opening a hard tag of the initially-mentioned type, and/or mechanically with a key.

The apparatus for generating an alarm are preferably activated (in the sense of being armed) during and by the closure of the securing device. Naturally an alarm is not initiated by this activation. However, the apparatus for generating an alarm can be designed such that they signal their activation by a blinking signal and/or an acoustical control sound.

The deactivation of the apparatus for generating an alarm is done in the case of an authorized opening, preferably using a special magnetic opener or a key for this purpose. However, the activation may also be provided electronically by remote control or by a deactivator plate. In this case, an alarm, for example, would still be triggered if the securing device is opened with a special magnetic opener or key provided for this purpose. In the case of possible opening of the securing device, naturally, likewise the activation of the apparatus for producing an alarm would be suppressed, and an alarm would be produced.

The apparatus for producing an alarm may be designed to generate a multi-stage alarm in terms of intensity and/or duration. This can be used to set off a warning pre-alarm if the securing device is even slightly lifted from the object and/or if the securing device is only slightly shifted on the object. This may already be sufficient to deter the person performing the manipulations from continuing these manipulations without causing a general uproar. In particular, only an alarm at a level lower than the highest alarm stage may be triggered if only the optical sensor (19) responds. Especially if this is at a sensitive setting, this can take place even during authorized handling of the object.

The securing device according to the invention is preferably designed such that it can be attached to the object with a belt or several belts tensioned around the object to be secured. For example, this is accomplished in that in the open state of the securing device the base plate can be moved between the at least one belt and the object and that the base plate and the lid in the closed state of the securing device can be locked in contact with the at least one belt by the lock. In the case of a sales carton, the at least one belt can be attached in such a manner that the sales carton cannot be opened, at least without producing major damage to it.

For a secure and solid guidance of the at least one belt, the base plate can have at least one groove-like indentation and the lid, several recesses in which the at least one belt can be laid. In addition the securing device can have an apparatus to prevent slippage of the base plate on the object to be secured, which might be possible in the case of application with belts. This may for example be a rubber layer or the like disposed on the side of the base plate facing the object.

The securing device according to the invention could also be attached to an object to be secured using adhesive technology. For this purpose it would be possible to use an adhesive strip that has the characteristic that it loses its stickiness when stretched and can be removed from the object and the securing device without leaving residues. The adhesive strip should be covered by the base plate and contain a gripper for stretching it by a user, which is accessible only in the open state of the securing device.

The securing device according to the invention can also advantageously be designed such that it can be optionally attached to an object to be secured with belts or adhesive technology or a combination of the two methods. Finally the securing device can also have a two-strand cable as an additional apparatus for generating an alarm, wherein one end thereof is connected to a plug connection in the housing that is accessible only in the open state of the securing device, and the other end of which projects out of the housing and is provided with apparatus for attaching two additional objects. The apparatus for attaching additional objects in this case can comprise a further housing with a mechanical sensor which can detect contact with the further object through the additional housing and can react to loss of contact with the further object. The apparatus for attaching.

BRIEF DESCRIPTION OF THE DRAWINGS

In the following the invention will be explained in further detail based on an exemplified embodiment in connection with the drawing. This shows.

In the Figures, corresponding parts are provided with the same reference numbers.

DETAILED DESCRIPTION OF THE PRESENT INVENTION

Figure 1A:
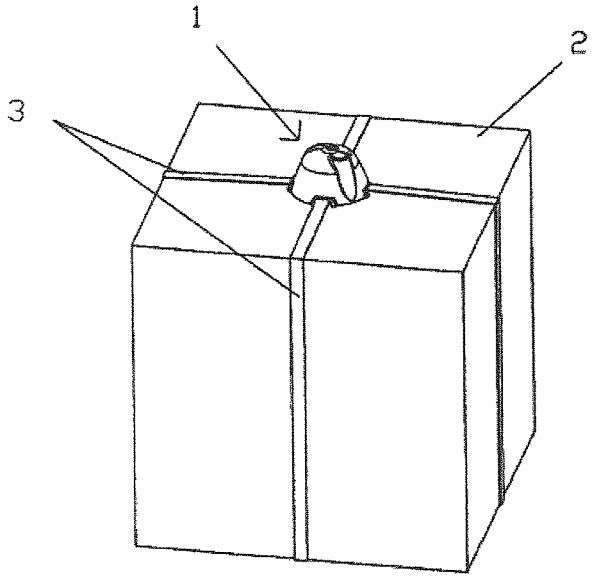
FIG. 1 a securing device according to the invention to an object clamped with two belts under *a*) in a perspective view and under *b*) in a top view.
Figure 1B:
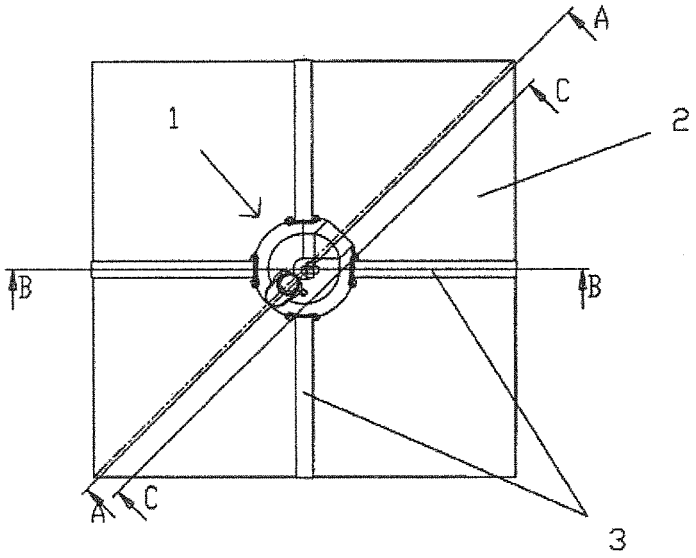

FIG. 1*a*) shows, in perspective view, an embodiment of a securing device 1 according to the invention, which is attached to an object 2, e.g., a sales carton, with two belts which cross one another. The securing device 1 is shown in the closed state and interacting with the belts 3. The two belts 3 travel through the securing device 1 and cross within it. The securing device 1 is held on the surface of the object 2 by the clamping of the belts 3. FIG. 1*b*) shows a top view of the securing device 1 and the object 2 from FIG. 1*a*) clamped with the belts 3.

Figure 2A:
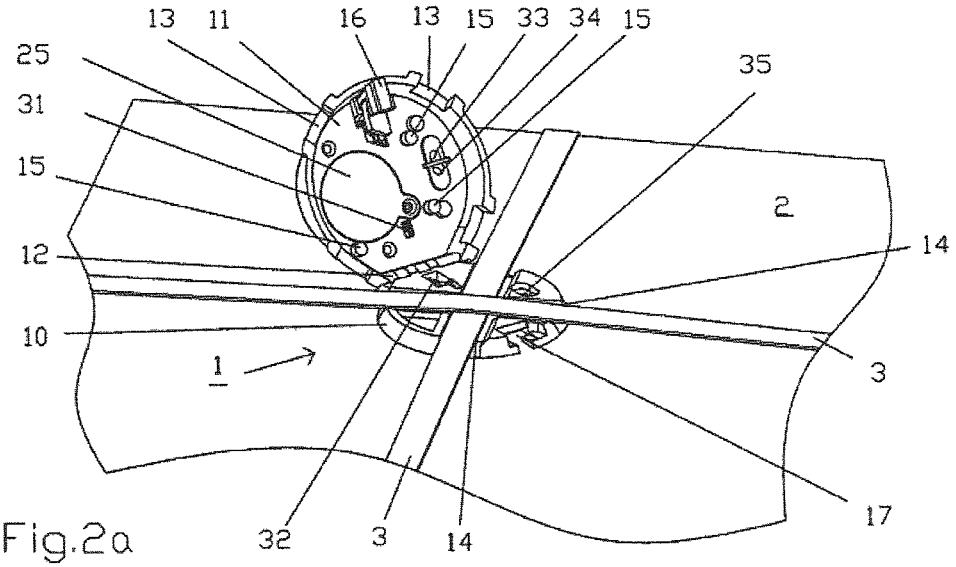
FIG. 2 perspective views of the securing device from FIG. 1 under *a*) in the open state and under *b*) in the closed state.
Figure 2B:
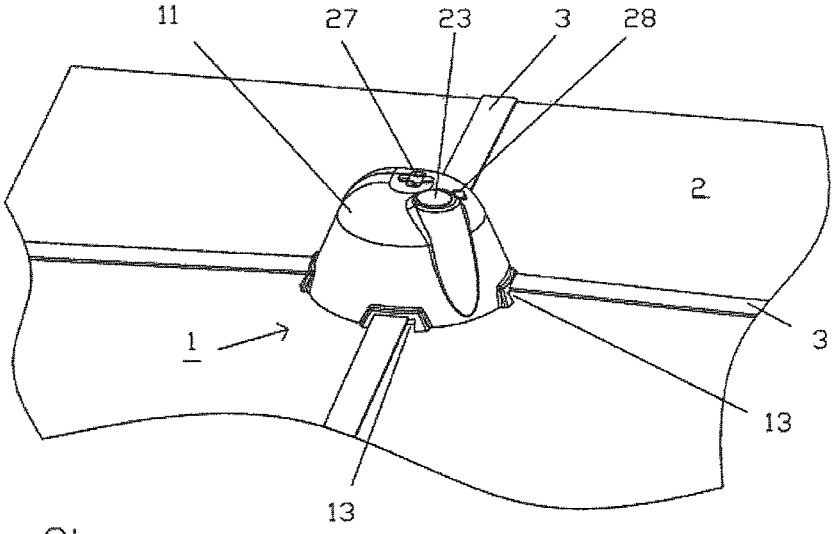
Figure 3A:
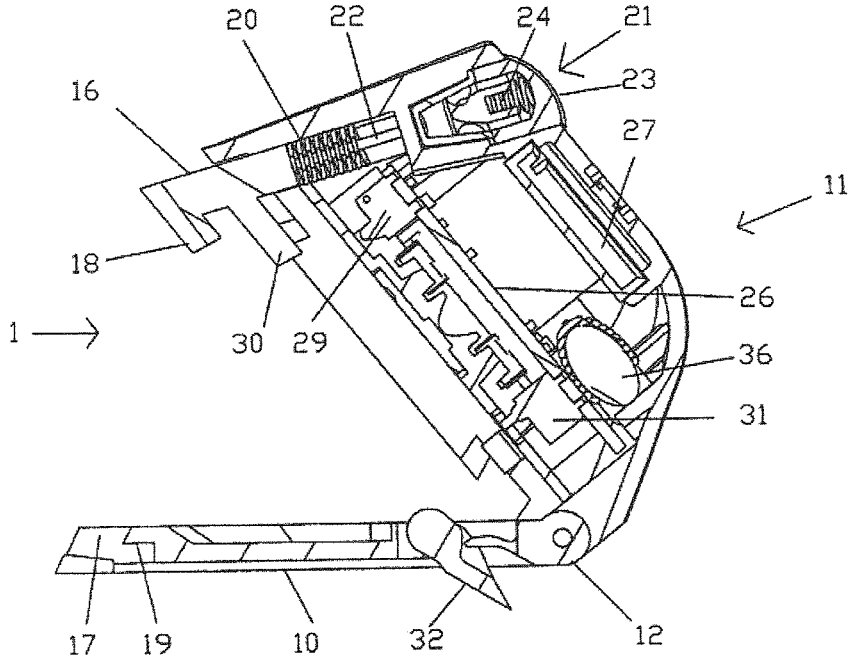
FIG. 3 a view along section A-A from FIG. 1*b*) under *a*) in the open state and under *b*) in the closed state.
Figure 3B:
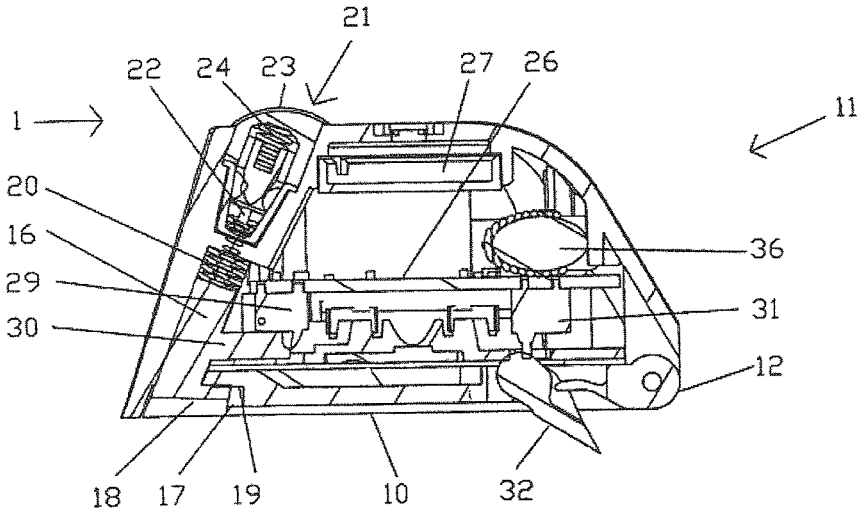
Figure 4:
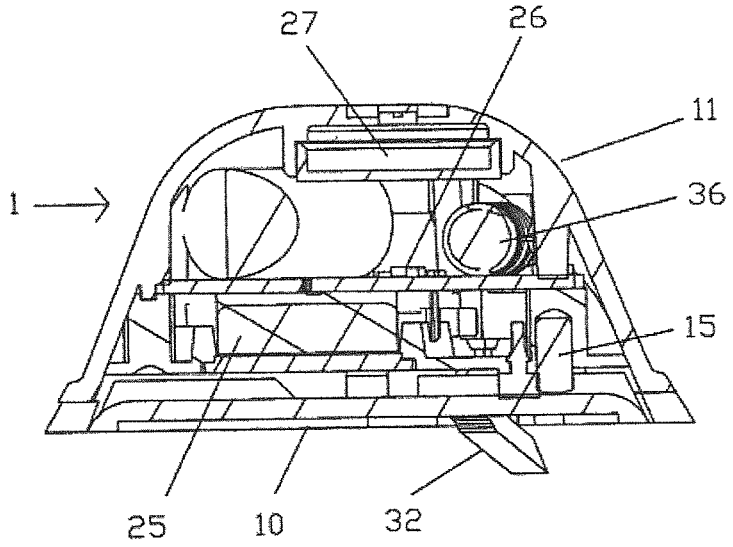
FIG. 4 a view along section B-B from FIG. 1*b*) in the closed state.

In FIG. 2*a*), the securing device 1 from FIG. 1*a*) is shown in perspective view in the open state. FIG. 2*b*) shows the securing device 1 in the closed state. In each case only one surface, on which the belts 3 cross, of the object 2 is shown in FIG. 2*a*) and FIG. 2*b*). FIG. 3 shows the securing device 1 from FIG. 1 in only one sectional view along the section line A-A from FIG. 1*b*) in the open state (FIG. 3*a*) and in the closed state (FIG. 3*b*). FIG. 4 shows the securing device only in a view of the section along line B-B from FIG. 1*b*) and FIG. 5 in a view and the section along the section line C-C from FIG. 1*b*), in each case in the closed state.

The securing device 1 has a housing comprising a base plate 10 and a lid 11. Lid 11 and base plate 10 are connected movably together over a hinge 12. In the open state, the securing device 1 with the base plate 10 can be slid between the surface of the object 2 and the belts 3 encircling the object 2, so that the belts 3 cross in the center of the base plate 10. For guiding the belts 3, the base plate 10 has two likewise crossing, groove-like indentations 14. The lid 11, shown still in the flapped-back state in FIG. 2*a*), along its edge has recesses 13 for the belts 3 that pass through the securing device 1. In addition the lid 11 has several cylindrical projections 15 on the surface that faces the base plate 10 in the closed state. These projections 15, the function of which will be explained below, are arranged such that in the closed state of the securing device 1, they are located in the area of the groove-like indentations 14.

The lid 11 is lockable with the base plate 10 in the closed state of the securing device 1. The lock provided for this purpose has a hook-shaped slide 16, which can be slid into the lid 11 between two positions. The extended position of the slide 16 is shown in FIG. 3*a*) in the open state of the securing device while FIG. 3*b*) shows the slide 16 in its slid-in position in the closed state of the securing device. Here the slide 16 meshes in a recess 17 in the base plate 10 and with its hook-shaped end 18 meshes with the inner edge 19 thereof from below. This meshing from below occurs in that when the lid 11 is closed, the slide 16, proceeding from its extended position, is pressed at an oblique angle relative to the base plate 10 into the lid 11 as soon as it has come into contact with the recess 17 and in front of it. In this process the spring 20 also disposed between the slide 16 and the lid 11 is clamped, which applies a force to the lid 11 in the direction of opening and then to slide 16 into its extended position, and the resistance of which is to be overcome upon closing the lid 11.

However, in the closed state according to FIG. 3*b*, the opening of the lid 11 under the action of the spring 20, is prevented by a magnetic lock 21 provided in the lid 11. The lock 21 is of a type already known from so-called hard tags. Upon movement of the slide 16 into its pushed-in position, a slender pin 22 connected to the slide 16 is introduced into the lock 21, where it is prevented from moving back by spring-loaded balls. Thus upon closing the lid 11, the lid 11 and the base plate 10 are automatically locked together in the closed position of the securing device, without further manipulation being required.

To loosen the lock, the balls of the lock 21 must be pulled away from the pin 22 through the force of a magnet to be applied at 23 against the action of a spring 24 acting on it, so that this pin is freed and can be withdrawn from the lock 21. Under the action of the spring 20, the lid 11 automatically springs open and the slide 16 springs into its extended position.

The apparatus for generating the alarm are also essentially arranged in the lid 11. These apparatus comprise a battery 25 (in FIG. 2*a*), 25 identifies the battery compartment), an electronic unit (PCB, circuit board) 26, an acoustic signal generator (buzzer) 27, an applicable signal generator (LED) 28 and a main switch 29. The latter is actuated by a peg 30 formed on the slide 16 that, with the lid 11 closed and the slide 16 slid in, closes the battery current circuit. With the lid 11 open and the slide 16 extended, the battery power circuit is interrupted by the main switch 29. The apparatus for generating an alarm are thus activated by the closure of the securing device and deactivated upon opening the securing device.

Figure 5:
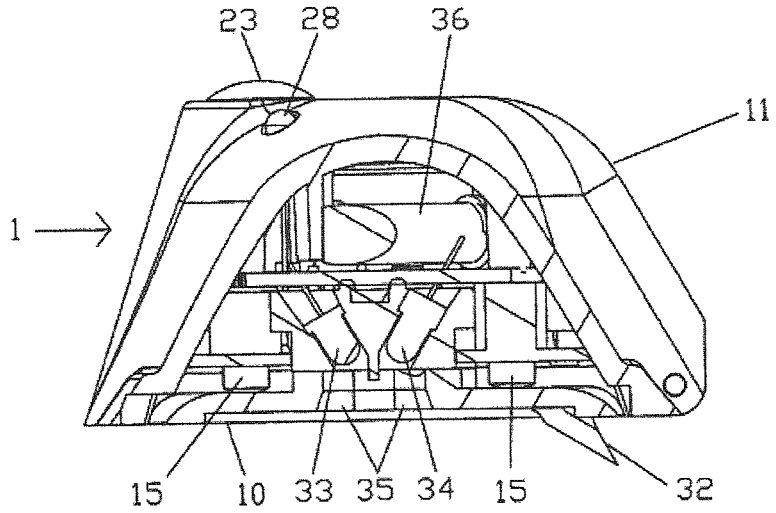
FIG. 5 a view along section C-C from FIG. 1*b*) in the closed state.

The apparatus for generating the alarm also comprise a mechanical and an optical sensor, wherein these may also be provided alternatively. The mechanical sensor comprises in the lid 11 a contact switch 31 and in the base plate 10 a pivotably arranged feeler 32, which interact in the closed state of the securing device. The feeler 32 is spring-loaded in such a way that normally as shown in FIGS. 3-5 it projects downward over the base plate 10. On the other hand, when the securing device is placed on an object 2 in the manner of FIG. 1 and with its base plate 10 is in contact with the object 2 under a pressing pressure formed by the tension belts 3, the feeler 32 is pivoted back by the object 2 into the base plate 10, actuating the contact switch 31. The contact switch 31 thus occupies a switching position from which the electronic device 26 deduces the presence of the object 2.

If the securing device in the closed state is removed from the object 2, for example after the belts 3 are cut, the feeler 32 pivots out from the base plate, whereupon the contact switch 31 is actuated and as a result achieves a switching position from which the electronic part 26 deduces a loss of contact with the object and emits an alarm (acoustic via the buzzer 27 and/or optical via the LED 28). The contact switch 31 could also have several switching steps, so that a merely slight lifting of the securing device from the object generates only a preliminary alarm, for example brief lighting of the optical signal generator (LED) 28, in the sense of warning against further manipulations.

The optical sensor, designed as a reflected electric eye, is recognizable in FIG. 5 and has a light emitter 33 and a reflected light receiver 34. It is preferably insensitive to ambient light, in that the light emitter 33 emits infrared light and the reflected light receiver 34 is sensitive only to infrared light.

In the closed state of the securing device, the light emitter 33 emits light at an oblique angle through an opening 35 in the base plate 10. If the securing device in the manner of FIG. 1 is attached to an object 2, part of this light is reflected on the surface of the object 2, and through the opening 35 reaches the reflected light receiver 34. The reflected light receiver 34 is shielded from direct light from the light emitter 33. Depending on the nature of the surface in terms of brightness, color and/or luster, but also depending on the distance from the surface, more or less reflected light will reach the reflected light receiver. To take the respective conditions into consideration, after application and closure of the securing device on an object, first the electronic section determines the intensity of the respectively received light and stores this as a reference value. After this it can respond to changes in the intensity of light received.

Such changes are especially to be expected if the securing device is removed from the object, wherein even a slight lifting of the securing device from the object within the flexibility range of the object or the belts may be sufficient. Detectable changes can also be caused if a flat object is slid between the securing device and the object, and has somewhat different reflection properties, which will usually be the case. By inserting a flat object in the form of a stiff card between the securing device and the object, anyone could attempt to move the securing device from the object without the mechanical sensor emitting an alarm, in that upon removing the securing device, the flat object is used to prevent the feeler 32 from pivoting out of the base plate 10.

The optical sensor can also record changes caused by setting the securing device on an object with a textured surface. In order to avoid setting off alarms during authorized handling of the object, the securing device should be fixed well onto the object with the belts and should be movable as little as possible. In the present exemplified embodiment therefore the previously mentioned cylindrical projections 15 in the cover 11 are provided. In the closed state of the securing device they press on the belts 3, which are conducted along the groove-shaped indentations 14 of the base plate 10, and clamp these firmly, so that the securing device 1 cannot be slid along the belts 3. The cylindrical projections 15 for example may consist of an elastic material. To further impede unwanted sliding of the securing device 1 relative to the surface of the object 2, the base plate 10 and the side facing the object 2 can also be provided with a rubber coating.

Alternatively or additionally it may be provided that an alarm would only be triggered if the displacement exceeds a certain amount in the given case. Furthermore the emission of an alarm or a pre-alarm of lower intensity and/or duration, as described above for the mechanical sensor, may be provided.

In an alternative embodiment, a light sensor that is sensitive to ambient light may be used. In this case for example the light sensor could simply respond to the change in brightness that occurs when the securing device is lifted from the object.

As an additional apparatus of alarm generation, in the lid 11 of the present embodiment an electrical resonant oscillating circuit consisting of a coil and capacitor is present, which can be energized and detected by an electronic goods securing unit such as those installed in many retail stores. The coil has a ferrite core designated as 36. When the resonant oscillating circuit is energized, the electronic unit 26 emits an alarm.

As explained, upon unlocking, the cover 11 springs open under the influence of the spring 20 and the slide 16 moves into its extended position, wherein the battery power circuit is interrupted by the main switch 29. After this, the securing device can be removed from the object 2 without an alarm being set off.

The securing device is designed in terms of stability of its parts in such a manner that they block attempts to break them off by force to a certain degree. The weakest link, which, if any, will be the first to yield in the case of an attempted forcible opening, is preferably the meshing of the hook-like end 18 of the slide 16 with the edge 19. For example it may be provided that the hook-like end 18 slips over the edge 19 or breaks off from the slide 16. The slide 16 remains in its slid-in position in the lid 11 and with it, the peg 30, so that the main switch 29 also remains in its position, closing the battery power circuit. Thus the apparatus for alarm generation also remain active. If the lid 11 is opened after such a breaking off by force, its distance from the object changes, which is detected by both the mechanical and the optical sensors, which then emit an alarm.

Figure 6A:
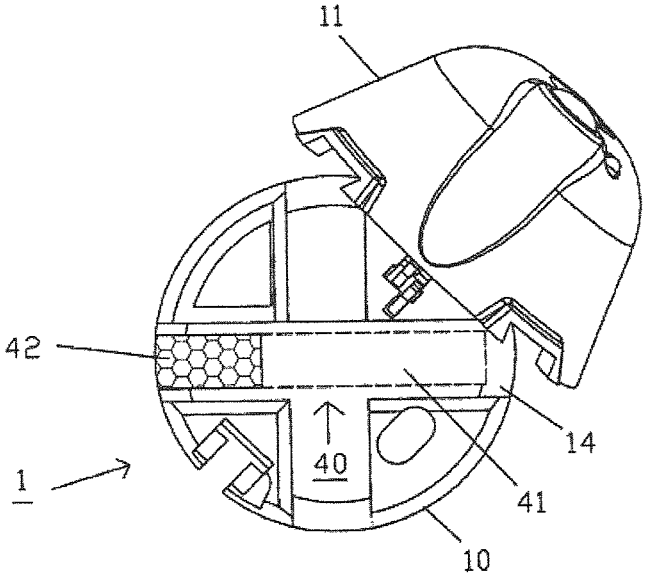
FIG. 6 the securing device of FIG. 1, provided with an adhesive strip, in the open state under a) in top view and under b) in side view.
Figure 6B:
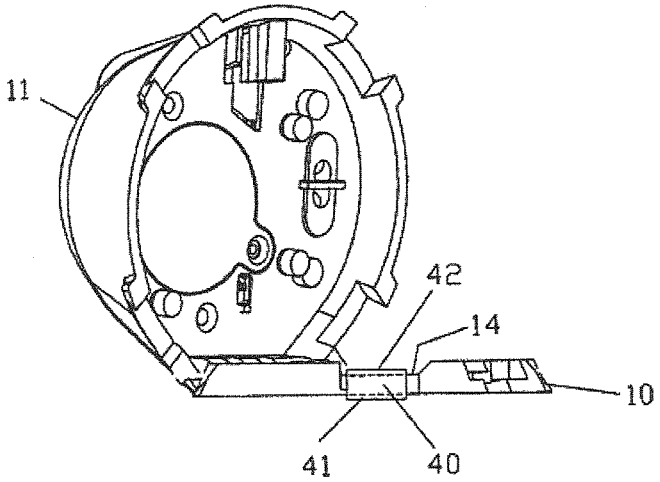

FIG. 6 shows the securing device of FIG. 1 provided with an adhesive strip 40. This has a first, double adhesive section 41, with which on one hand it attaches to the underside of the base plate 10, and on the other hand to an object. In the front view of FIG. 6*a*), section 41 itself is not visible and therefore it is only indicated by a broken outline. A second, non-adherent section 42 of the adhesive strip 40 is placed around the edge of the base plate 10 and into one of the groove-like indentations 14 of the base plate.

When the securing device is adhered to an object, the section 41 of the adhesive strip 40 is covered by the base plate 10, and after closing of the lid 11, its section 42 also is no longer accessible. In the open state on the other hand the section 42 can be grasped and swung out of the indentation 14. By pulling on the section 42 as an extension of the section 41, the latter is stretched, losing its adhesiveness. After this the adhesive strip 40 can be removed from both the securing device and also the object, wherein no adhesive residues remain on this. To again connect the securing device to an object, the adhesive strip of the type described is stuck to the base plate in the manner described.

Figure 7:
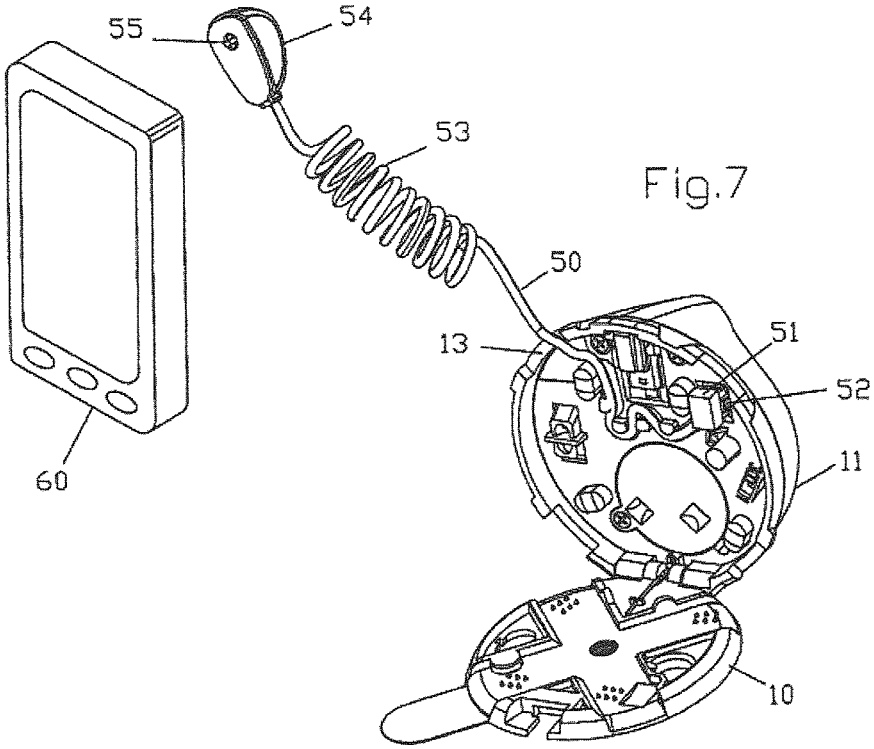
FIG. 7 a securing device according to the invention, which is expanded by a cable 50 according to a first embodiment, with which cable it can be connected to another object.

FIG. 7 shows an expansion of the securing device of FIG. 1 by a cable 50, with which it can be bound to another object as well to secure this additionally if desired. In the securing device of FIG. 7 a two-strand cable 50 is provided, one end of which is provided with a plug and is inserted with this plug 51 in the lid 11 of the housing into a socket 52 present there. In the closed state, when the lid 11 is locked with the base plate 10, the cable end mentioned with the plug connection consisting of plug 51 and socket 52 is not accessible from the outside. The plug connection is thus unable to be separated in the closed state. The cable end mentioned is further secured against pulling out in the closed state with several baffles in the lid 11. The largest part of the cable 50 projects out of the housing through one of the recesses 13 and is provided there with several spiral windings 53, so that its length is flexibly adaptable to the relative distance to the other objects. At its free end the cable 50 is provided with an apparatus for attachment to an additional object.

FIG. 7 shows a first embodiment of such apparatus in the form of an additional, substantially smaller housing 54. A mechanical sensor is present in this, which through the further housing 54 can detect contact with an additional object and can react to loss of contact with the additional object. This mechanical sensor in turn can involve a contact switch with a feeler 55, which is spring-loaded such that it normally projects out of one side, somewhat above the housing 54. The housing 54 is simply adhered by an adhesive strip (not shown), especially one of the previously-described type, by the side mentioned to an additional object, for example the object 60 shown in FIG. 7, so that the feeler 55 is pushed back by it into the housing 54. The contact switch thereby closes a circuit over the cable 50 and the plug connection 51, 52, which is connected by the above-described apparatus to the alarm generator in the lid 11 of the securing device. In the case of loss of contact between the remainder of the housing and the additional object, these apparatus in the lid 11, when they are activated, generate an alarm of the likewise previously-described type. A suitable surface for clamping the housing 54 as described can be found on most objects, wherein this is helped by the fact that the housing 54 may be made relatively small, e.g., only 1-4 cm in length and/or width.

Figure 8:
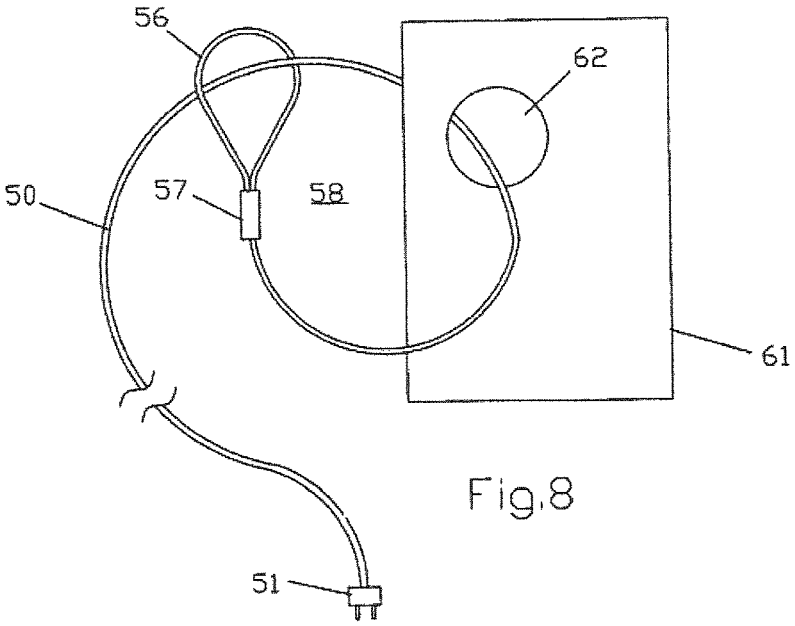
FIG. 8 another embodiment of such a cable.

The embodiment according to FIG. 8 gets by without adhesive strips for attachment to an additional object. Instead, however, the object must have an opening or the like. At the free end of the cable 50 in FIG. 8 an eye 56 is formed. The two strands of the cable 50 are electrically connected in a sleeve 57 that closes the eye 56. As a result the cable 50 again forms a closed circuit, which is monitored for continuity by the alarm apparatus in the lid 11. The cable 50 is connected to an additional object such as the object 61 in FIG. 8, in that its end provided with the plug 51 is passed through a suitable opening 62 in the object 61, then stuck through the eye 56 to form a closed loop 58 and finally inserted into the socket 52 in the lid 11 of the housing. Here an alarm is generated by the alarm apparatus in the lid 11, for example if the cable 50 is cut to remove the additional object.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

We claim:

1. A securing device for attachment to an object that is to be secured, wherein the securing device comprises a housing with a base plate and a lid as well as an apparatus for generating an alarm when the securing device is removed from the object without authorization, wherein said base plate and said lid are selectively movable relative to one another between an open state wherein said lid at least partially separated from said base plate and a closed state wherein said lid is not separated from said base plate, while said securing device is attached to an object to be secured, and wherein a lock releasably locks said base plate and said lid to one another in the closed state, said lock having a locking condition and a releasing condition, and at least one non-electrically conductive belt for extending around the object for attaching the securing device to the object, the at least one non-electrically conductive belt being devoid of an alarm structure for generating an alarm in response to the cutting of the at least one non-electrically conductive belt; wherein the apparatus for generating an alarm comprises a mechanical sensor and an optical sensor, wherein in response to said base plate and said lid being in the closed state the mechanical sensor through the base plate detects contact with the object and responds to loss of contact with the object and effects the generation of the alarm in response to the loss of contact with the object, and wherein the optical sensor includes a light source for emitting light through the base plate and detects reflections of the light from the object through the base plate, and reacts to changes in the reflections and effects the generation of the alarm in response to the changes in the reflections even in the event of the disabling of the mechanical sensor.

2. The securing device according to claim 1, further comprising a hinge for removably connecting the base plate and the lid to one another for enabling the selective movement of said base plate relative to said lid while the securing device is attached to the object.

3. The securing device according to claim 1, wherein the mechanical sensor comprises a contact switch for contacting the object to which the securing device is attached when said base plate and said lid are in the closed state and generates an alarm in response to the removal of the securing device from the object.

4. The securing device according to claim 1, wherein the optical sensor comprises an electric eye or an image sensor.

5. The securing device according to claim 4, wherein the optical sensor is insensitive to ambient light.

6. The securing device according to claim 5, wherein the optical sensor emits infrared light.

7. The securing device according to claim 1, wherein the apparatus for generating an alarm comprises a resonant oscillating circuit detectable by an electronic goods securing unit and generates an alarm when the resonant oscillating circuit is energized by the electronic goods securing unit.

8. The securing device according to claim 1, wherein the securing device includes a hook-shaped slide and a spring for biasing said hook-shaped slide into locking engagement with said base plate in response to moving said base plate and said lid relative to one another from said open state to said closed state to activate the locking of said base plate and said lid by the hook-shaped slide and said base plate.

9. The securing device according to claim 1, wherein the lock is magnetically releasable with a magnetic opener and/or is mechanically releasable with a key.

10. The securing device according to claim 1, wherein closing the securing device activates the apparatus for generating an alarm.

11. The securing device according to claim 1, wherein releasing the lock deactivates the apparatus for generating an alarm.

12. The securing device according to claim 1, wherein the apparatus for generating an alarm can be deactivated by remote control or by a deactivator plate.

13. The securing device according to claim 1, wherein the apparatus for generating an alarm generates a multistage alarm in terms of intensity and/or duration.

14. The securing device according to claim 1, for objects that are prevented from being opened, wherein said at least one non-electrically conductive belt is clamped around the objects that are prevented from being opened, wherein the base plate in the open state is slidable between the belt and the respective objects that are prevented from being opened, and wherein the base plate and the lid in the closed state are lockable in engagement with the belt by the lock.

15. The securing device according to claim 14, wherein the base plate comprises at least one groove-like indentation and/or the lid comprises several recesses in which the belt can be inserted for accommodating the belt.

16. The securing device according to claim 14, wherein said device comprises an apparatus to prevent slipping of the base plate on the object to be secured.

17. The securing device according to claim 1, further comprising a double-adhesive adhesive strip having an initial adhesiveness for fastening said device to an object to be secured, wherein the adhesive strip loses adhesiveness when stretched and is removable from the object and the securing device, wherein the adhesive strip is completely covered by the base plate and has a grip for stretching which is accessible only in the open state of the securing device.

18. The securing device according to claim 1, wherein said apparatus for generating an alarm comprises a two-strand cable, wherein one end of said cable is connected to a plug connector disposed in the securing device and is accessible only when the securing device is in the open state, and wherein the other end of said cable is a free end projecting out of the securing device, and the free end is provided with an apparatus for attachment to an additional object.

19. The securing device according to claim 18, wherein the apparatus for attachment to an additional object comprises an additional housing with a mechanical sensor for detecting contact with the additional object through the additional housing and in the case of loss of contact with the additional object, breaks an electrical connection between the two strands of the cable.

20. The securing device according to claim 18, wherein the apparatus for attachment to an additional object comprises an eye on the cable end and a sleeve in which the two strands of the cable are electrically connected to one another.

* * * * *